United States Patent [19]

Meier

[11] 4,267,997

[45] May 19, 1981

[54] SUPPORT FRAME FOR A FLEXIBLE BAG

[76] Inventor: William E. Meier, 3512 E. Montecito, Phoenix, Ariz. 85018

[21] Appl. No.: 94,642

[22] Filed: Nov. 15, 1979

[51] Int. Cl.[3] ..... A63B 55/04

[52] U.S. Cl. ..... 248/97; 220/19; 248/153

[58] Field of Search ..... 248/95, 97, 98, 150, 248/153; 150/17, 48; 232/43.2; 53/390; 141/390; 220/19

[56] References Cited

U.S. PATENT DOCUMENTS

| | | | |
|---|---|---|---|
| 70,769 | 11/1867 | Woods et al. | 220/19 X |
| 1,895,904 | 1/1933 | Lutts et al. | 248/97 X |
| 2,010,789 | 8/1935 | Roesel | 248/95 |
| 2,942,823 | 6/1960 | Chapman | 248/97 |
| 3,240,457 | 3/1966 | Backlund et al. | 248/97 |
| 3,373,963 | 3/1968 | Snell | 248/97 |

FOREIGN PATENT DOCUMENTS

| | | | |
|---|---|---|---|
| 491594 | 3/1954 | Italy | 220/19 |
| 903,859 | 8/1962 | United Kingdom | 220/19 |

*Primary Examiner*—J. Franklin Foss

*Attorney, Agent, or Firm*—Cahill, Sutton & Thomas

[57] ABSTRACT

A skeletal frame, configured in cross-section size to the lateral dimensions of an expanded collapsible bag and including bottom frame members for providing vertical support to the collapsible bag, provides structural support for the collapsible bag during fill thereof. Handles attached to the frame translate a lifting force applied thereto through the frame to the bottom and sides of the collapsible bag, regardless of the degree of fill of the collapsible bag.

4 Claims, 4 Drawing Figures

SUPPORT FRAME FOR A FLEXIBLE BAG

The present invention relates to support frames and, more particularly, to support frames for collapsible bags.

Trash receptacles, whether they be waste baskets or garbage cans, are circular or rectangular in cross-section and invariably have imperforate sides and bottom. These trash receptacles are often lined with a disposable collapsible bag. Almost never does the collapsible bag have dimensions commensurate with that of the trash receptacle. Therefore, segments of the collapsible bag present folds extending into the trash receptacle, which folds impose upon and diminish the trash capacity of the trash receptacle. Where the collapsible bag has a substantial amount of "body" to it, such as conventional paper grocery bags, the space occupied by the folds may be a substantial percentage of the trash receptacle's capacity and thereby substantially reduces the quantity of trash disposable therein.

Most trash receptacles which have imperforate surfaces are substantial in weight in proportion to the weight of the trash disposable therein. Accordingly, transport of a filled trash receptacle requires a lifting or translating force substantially more than that required for the trash itself.

With the increasing costs of raw materials, any quantity of material saved during the fabrication of articles may present a substantial cost savings. Thus, surfaces or components of articles which need not be imperforate for the article to perform its function, should be perforated to the extent possible and commensurate with structural strength requirements to reduce the amount of raw material consumed by the article.

It is therefore a primary object of the present invention to provide a skeletal support frame for collapsible bags.

Another object of the present invention is to provide a skeletal support frame sized commensurate with a supported expanded collapsible bag.

Yet another object of the present invention is to provide a skeletal frame for collapsible bags which provides vertical and lateral support for articles deposited within the collapsible bag.

Still another object of the present invention is to provide a skeletal frame for collapsible bags which requires the collapsible bag to have only a minimum tensile strength to keep items deposited therein within the collapsible bag.

A further object of the present invention is to provide a skeletal frame for transporting a filled collapsible bag.

A yet further object of the present invention is to provide a lightweight frame for supporting a collapsible bag.

A still further object of the present invention is to provide a low material content support frame for a collapsible bag.

These and other objects of the present invention will become apparent to those skilled in the art at the description thereof proceeds.

The present invention may be described with greater specificity and clarity with reference to the following drawings, in which.

Figure 1:
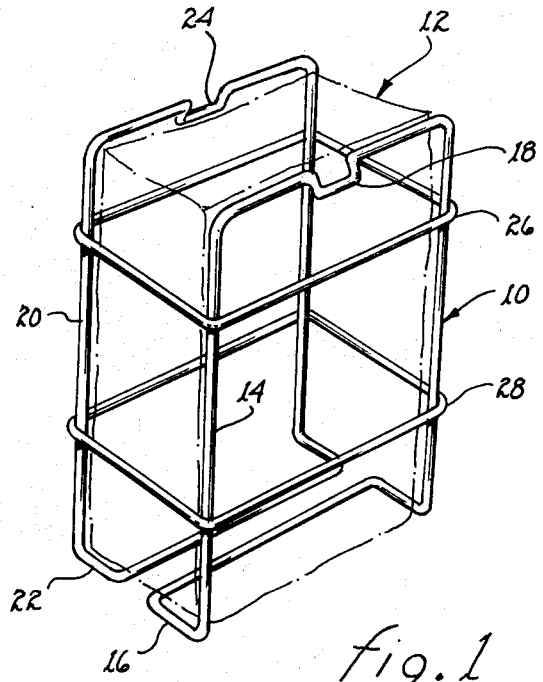
FIG. 1 is a perspective view of a supporting frame and a supported collapsible bag.

Referring to FIG. 1, there is illustrated a skeletal frame 10 supporting an internally disposed collapsible bag 12. Preferably, the width, breadth and heigth of the frame are essentially commensurate with the corresponding dimensions of the collapsible bag when the latter is in its expanded state to maximize the useable volume defined by the collapsible bag. Moreover, the resulting lack of folds in the collapsible bag eliminates the folds as impediments to compact packing of items within the collapsible bag.

Figure 2:
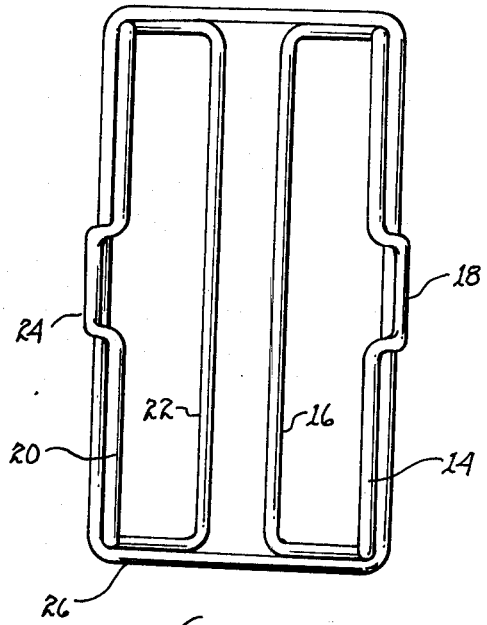
FIG. 2 is a top view thereof.
Figure 3:
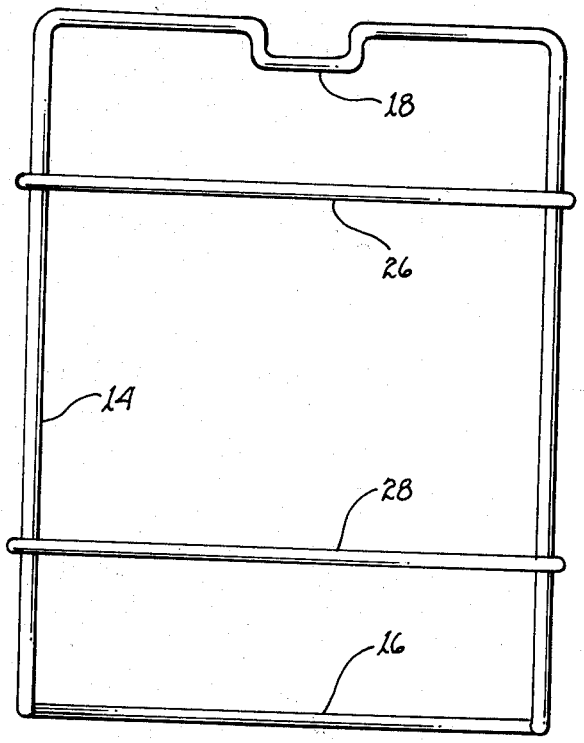
FIG. 3 is a side view thereof.
Figure 4:
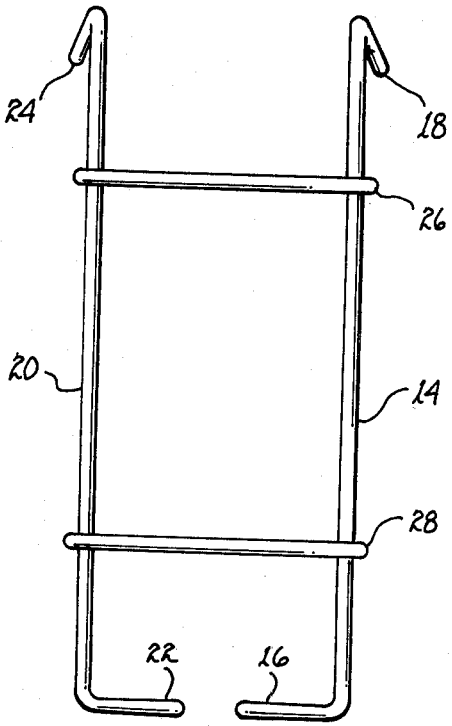
FIG. 4 is an end view thereof.

The components of skeletal frame 10 will be described with joint reference to FIGS. 2, 3 and 4. Preferably, the skeletal frame is constructed of four separately fabricatable articles. Upright element 14 may be fabricated from a length of wire or the like into an unbroken rectangular-like shaped element. The lower portion 16 of upright element 14 is bent transverse to the plane defined by the remainder of the upright element and serves as part of the bottom of the skeletal frame to support collapsible bag 12. A handle 18 is developed in the opposite end of upright element 14. The handle may be laterally angled, as illustrated, to permit gripping thereof without interference with the interiorly disposed side of the collapsible bag.

Upright element 20 is fabricated as a mirror image of upright element 14 and includes lower portion 22 and handle 24.

Both of the upright elements are positionally maintained with respect to one another by rings or bands 26 and 28. These bands, which may be rectangular shaped and fabricated of wire, as illustrated, are commensurate in length with the width of the upright elements and commensurate in width with the width of the collapsible bag when in the expanded state. The bands are mounted and attached to upright element 14 and 20 in a circumscribing relationship, as illustrated, so as not to impede insertion or removal of collapsible bag 12. Nevertheless, the bands may be disposed interior of the upright elements where manufacturing and cost criteria so dictate.

Assembly of the two upright elements and the two bands to develop the skeletal frame may be effected by welding the corners of the bands to the respective portions of each of the upright elements. Such welding process is readily performed and does not require a high degree of skill. Accordingly, the four components of the skeletal frame may be manufactured inexpensively by mass production techniques and final assembly of the skeletal frame may be by machine or by welders having only a modicum of skill.

In operation, a collapsible bag 12 is inserted within skeletal frame 10 and manually expanded so as to come into contact with the inside edges or surfaces of lower portions 16, 20 and the inside edges or surfaces of upright elements 14, 16 and the inside edges or surfaces of bands 26, 28. By engaging the sides of the bag with the downwardly laterally extending handles, the bag is held open to facilitate deposit of trash. Any items, such as trash, deposited within the collapsible bag will receive vertical support from lower sections 16 and 22 and lateral support directly from the upright arms of upright elements 14, 16 and the interior surfaces of bands 26 and 28. Since collapsible bag 12 will have some tensile strength, it will be capable of providing sufficient lateral support to any items or trash deposited within the bag which might not come into supporting contact with the upright elements or the bands since any lateral forces imposed by such items or trash would be as a result of lateral sliding and relatively small.

Transport of filled collapsible bag 12 to a depository is readily accomplished by grasping handles 18 and 24 and lifting or carrying the skeletal frame to the depository. During such carrying, the skeletal frame will continue to support the collapsible bag and the probability of the bag bursting in transit is extremely low.

Removal of a filled collapsible bag 12 is readily effected by grasping the upper edges of the bag intermediate upright elements 14 and 20 in pulling upwardly. As some friction between the bag and the skeletal frame will exist, it may be prudent to place one's foot on either lower section 16 or 22 to prevent upward movement of the skeletal frame with the collapsible bag. As the collapsible bag is dimensioned essentially commensurate with the internal dimensions of the skeletal frame, it is unlikely that the bag will contain protrusions due to the housed items or trash. Thereby, interference between the bag and the rings is unlikely.

It is to be understood that skeletal frame 10 may be used to support bags for a variety of purposes at a variety of locations. In example, the skeletal frame may be configured in size to accept a conventional grocery bag to receive trash; alternatively, the skeletal frame could be reduced in size and include attachment means for securing the frame to a hospital bed to permit the deposit therein by patients of facial tissues or other disposable articles of small size. Many other uses would also come to mind; moreover, the skeletal frame may be plastic coated or otherwise coated for protection against the elements, protection against scratching of adjacent articles or protection against tearing of the collapsible bag.

While the principles of the invention have now been made clear in a illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A skeletal frame for circumscribingly supporting a collapsible bag, said skeletal frame comprising in combination:

(a) a first upright wire like element having a width and length generally coincident with the width and length of the collapsible bag when it is in the expanded state;

(b) a second upright wire like element having a width and length generally coincident with the width and length of the collapsible bag when it is in the expanded state;

(c) vertically spaced first and second band means for interconnecting said first and second upright elements a distance apart from one another which distance is generally coincident with the breadth of the collapsible bag when it is in the expanded state;

(d) means including an inwardly bent section of each of said first and second upright elements at the lower end of each of said first and second upright elements for providing vertical support to the collapsible bag placed within said skeletal frame; and (e) handle means disposed at the upper end of each of said first and second upright elements for manually transporting said skeletal frame.

2. The frame as set forth in claim 1 wherein each said handle means is formed integral with the respective one of said upright elements and is angled laterally outwardly.

3. The frame as set forth in claim 2 including means for engaging the opposed upper edges of the collapsible bag to maintain open the opening of the collapsible bag.

4. The frame as set forth in claim 3 wherein said handle means includes said engaging means.

* * * * *